US007007311B2

(12) United States Patent
Chiang

(10) Patent No.: US 7,007,311 B2
(45) Date of Patent: Mar. 7, 2006

(54) SWIMMING GOGGLES WITH STRAP ADJUSTING DEVICE

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 34 days.

(21) Appl. No.: 10/873,260

(22) Filed: Jun. 23, 2004

(65) Prior Publication Data

US 2006/0010585 A1 Jan. 19, 2006

(51) Int. Cl.
*A61F 9/02* (2006.01)

(52) U.S. Cl. ..... 2/448

(58) Field of Classification Search ..... 2/445, 2/448

See application file for complete search history.

(56) References Cited

U.S. PATENT DOCUMENTS 5,189,447 A * 2/1993 Oleson ..... 351/121

6,024,446 A * 2/2000 Hall et al. ..... 351/120

* cited by examiner

*Primary Examiner*—Katherine M. Moran
(74) *Attorney, Agent, or Firm*—Troxell Law Office, PLLC

(57) ABSTRACT

A pair of swimming goggles (1) comprises left and right lens frames (2, 3) retaining lenses (9) therein, a connecting device (5) integrated with the lens frames, and a head strap (8) connecting outer sides of the lens frames. A strap adjusting device (4) is provided on the outer side of each lens frame, and comprises a base (40) and a panel (43) assembled together for extension and retention of the head strap, a push button (411) and a stop tongue (410) pivotally connected between the base and the panel, and two resilient arms (42) for providing resumption strength to the pressed push button. The stop tongue abuts against one side of a stop channel (80) of the head strap, whereby the head strap may be tightened by direct pulling, or loosened by pulling oppositely after the push button is pressed to release the stop tongue from the stop channel.

20 Claims, 4 Drawing Sheets

SWIMMING GOGGLES WITH STRAP ADJUSTING DEVICE

BACKGROUND OF THE INVENTION

1. Field of the Invention

The present invention relates to swimming goggles, and particularly relates to a pair of swimming goggles allowing the wearer to conveniently adjust the length of a head strap thereof without taking off the swimming goggles.

2. Description of Prior Art

It is well known that, for adjusting the length of a head strap of a pair of conventional swimming goggles, the wearer must take off the swimming goggles from her/his head to fulfill the operation. When adjusting, since it is difficult for the wearer to ascertain the length of the head strap exactly matching with her/his head, the wearer has to make several attempts before obtaining the optimal adjustment, which is tedious and inconvenient.

SUMMARY OF THE INVENTION

Accordingly, the object of the present invention is to provide a pair of swimming goggles allowing the wearer to conveniently adjust the length of a head strap thereof one time only without taking off the swimming goggles, so that the actual requirement of the wearer may be met in use.

To achieve the above object of the present invention, a pair of swimming goggles in accordance with the present invention is characterized in that the outer side of each lens frame of the swimming goggles is disposed with a strap adjusting device. The strap adjusting device comprises a base and a panel assembled into a unit for extension and retention of a head strap, a push button and a stop tongue pivotally connected with each other and positioned between the base and the panel, and a resilient element providing the resumption strength for the pressed push button to return to its original position. The stop tongue abuts against one side of a stop channel of the head strap in one direction, so that the wearer may tighten the head strap by pulling in the same direction. Alternatively, the wearer may press the push button to release the stop tongue from the stop channel of the head strap, whereby the head strap may be loosened by pulling in an opposite direction.

The resilient element consists of a pair of resilient arms on opposite sides of the push button. Each resilient arm has one end integrally connected with a fixed pivot upon which the push button and the stop tongue pivot, and the other end movably resting on the base. Consequently, when the push button is pressed, the resilient arms move downwardly with the push button and resiliently deforms. When the force exerted on the push button is removed, the push button returns to its original position by the restoring force of the resilient arms.

BRIEF DESCRIPTION OF THE DRAWINGS

The present invention may best be understood through the following description with reference to the accompanying drawings, in which.

DETAILED DESCRIPTION OF THE INVENTION

Figure 1:
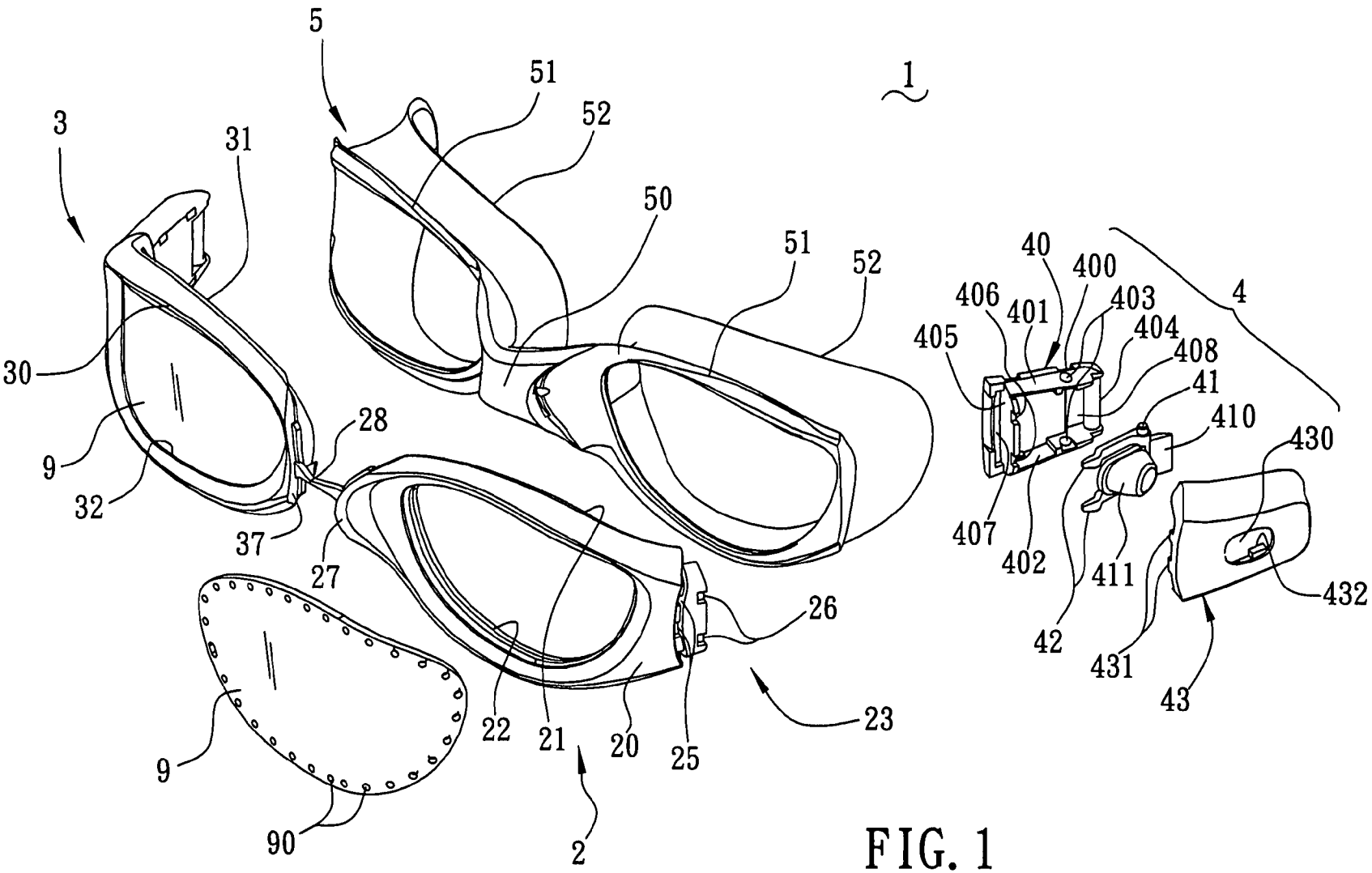
FIG. 1 is an exploded perspective view of a pair of swimming goggles in accordance with the present invention.
Figure 5:
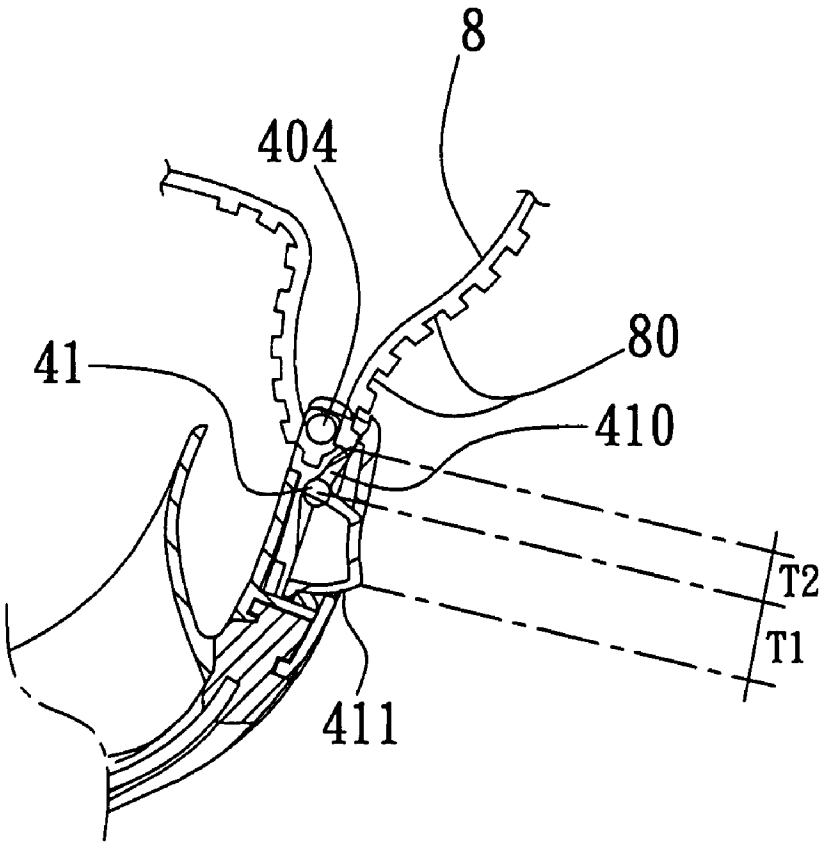
FIG. 5 is a view similar to FIG. 4, but illustrating the state when a push button thereof is pressed.
Figure 4:
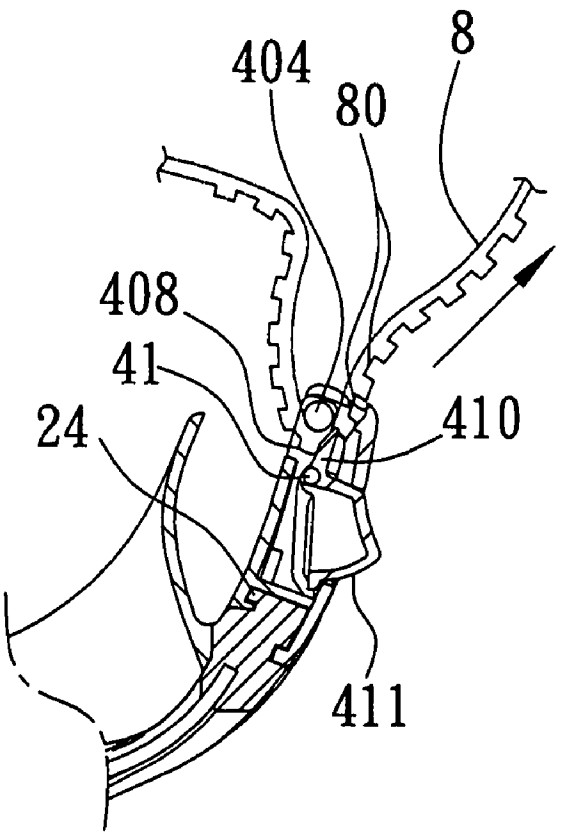
FIG. 4 is a cross-sectional view taken along line 4—4 of FIG. 3.

Referring to FIG. 1, a pair of swimming goggles 1 in accordance with the present invention comprises a left lens frame 2, a right lens frame 3, a strap adjusting device 4, a connecting device 5, and a head strap 8 defining a plurality of stop channels 80 (see FIGS. 4 and 5). Each lens frame 2, 3 is made of rigid materials, and has an outer surface 20, 30 and an opposite inner surface 21, 31 defining a receiving space 22, 32 therebetween for receiving a lens 9. A plurality of filling holes 90 is defined in the rim of the lens 9 for reinforcing the assembly of the lens 9 with the lens frame 2, 3. An engaging seat 23 having a reduced thickness is provided on an outer side of each lens frame 2, 3, thereby forming a step with the lens frame 2, 3. For simplification purposes, only the engaging seat 23 of the left lens frame 2 is shown in the drawings. It will be understood that, the engaging seat 23 of the right lens frame 3 has the same configuration as that of the left lens frame 2. The engaging seat 23 comprises a first engaging portion and a second engaging portion. In this preferred embodiment, the first engaging portion is in the form of an engaging strip 24 (shown in FIG. 4) formed on an outer side of the engaging seat 23, and the second engaging portion is in the form of a pair of positioning slots 25 defined in the junction of an inner side of the engaging seat 23 and the outer side of the lens frame 2, 3. A pair of grooves 26 is defined in the engaging seat 23 opposite to the pair of positioning slots 25. A bearing portion 27, 37 extends from an inner side of the lens frame 2, 3 for providing reliable connection between the lens frame 2, 3 and the connecting device 5. The bearing portions 27, 37 join at position 28.

The connecting device 5 is made of resilient materials, and comprises an integral nose bridge 50, a pair of enclosing frames 51 and a pair of gaskets 52. The nose bridge 50 is adapted to enclose the bearing portions 27, 37 of the lens frames 2, 3 therein. The enclosing frames 51 are adapted to be integrally connected to the inner surfaces 21, 31 of the left and right lens frames 2, 3, thereby connecting the left and right lens frames 2, 3 together as a unit. The gaskets 52 provide soft contact with the wearer's face.

The strap adjusting device 4 is adapted to be assembled to the engaging seat 23 of the lens frame 2, 3, and comprises a base 40, a stop lever, two resilient arms 42 and a panel 43. The stop lever consists of a fixed pivot 41, a stop tongue 410 and a push button 411. The base 40 has opposite side portions 401, 402 each defining a pivot hole 403 for receiving one end of the fixed pivot 41 of the stop lever. A strap post 404 is provided between the side portions 401, 402 and proximate to the pivot holes 403 for allowing the head strap 8 to be wound therearound. A projection 405 is provided between and outwardly projects beyond the side portions 401, 402. The projection 405 is located opposite to the strap post 404 and defines two concaves 406 at a free end thereof. A snapping portion 407 is provided proximate to the projection 405 for receiving the engaging strip 24 of the engaging seat 23 by a snap engagement therebetween. A strap opening 408 is further defined in the base 40 for allowing extension of the head strap 8 therethrough to be wound around the strap post 404.

The fixed pivot 41 of the stop lever is rotatablely received in the pivot holes 403 of the base 40. The stop tongue 410 of the stop lever is provided on one side of the fixed pivot 41 for abutting against an inner side of the stop channel 80 of the head strap 8 as shown in FIG. 4. The push button 411 is provided opposite to the stop tongue 410 and has an inclined surface for facilitating press operation of the wearer's finger. Also referring to FIG. 5, it is clearly shown that the push button 411 and the stop tongue 410 are pivotally connected to each other. The distance T1 between the fixed pivot 41 and the tip of the inclined surface of the push button 411 is larger than the distance T2 between the fixed pivot 41 and the free end of the stop tongue 410. Consequently, the push button 411 can be easily pressed, causing the stop tongue 410 to move correspondingly about the fixed pivot 41.

The resilient arms 42 are provided on opposite sides of the push button 410. Each resilient arm 42 has one end integrally extending from the fixed pivot 41, and the other end bent into a curved configuration for being movably received in a corresponding concave 406 of the projection 405 of the base 40. As the projection 405 outwardly projects beyond the side portions 401, 402, the resilient arms 42 rest on the projection 405 in an inclined manner, thereby providing sufficient space for movement of the resilient arms 42. It will be understood that, alternatively, the resilient arms 42 may be replaced by a spring that is disposed beneath the push button 411 to provide restoring force to the pressed push button 411 for recovery.

The panel 43 is adapted to be assembled to the base 40. The panel 43 has a hole 430 defined therein for extension of the push button 411 therethrough, and a latching portion in the form of two posts 431 corresponding to the positioning slots 25 of the engaging seat 23 for assembling the panel 43 to the lens frame 2, 3. The assembly of the panel 43 to the base 40 is achieved by the engagement between a pair of engaging slots 400 defined in opposite sides of a bottom portion of the base 40 and a pair of engaging posts 432 correspondingly provided on the panel 43.

Figure 2:
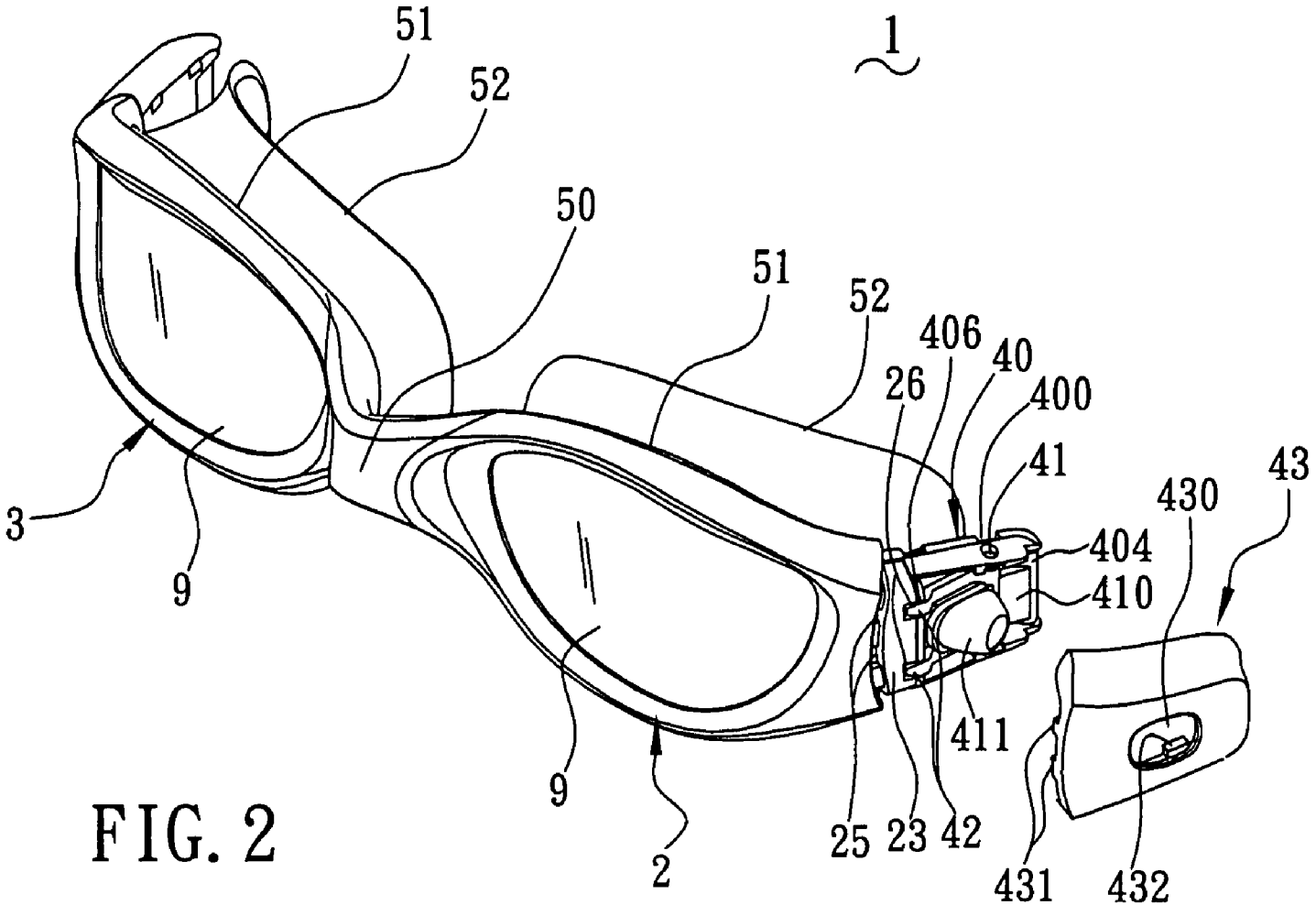
FIG. 2 is a partially assembled view of the swimming goggles of FIG. 1 with a panel thereof unassembled.
Figure 3:
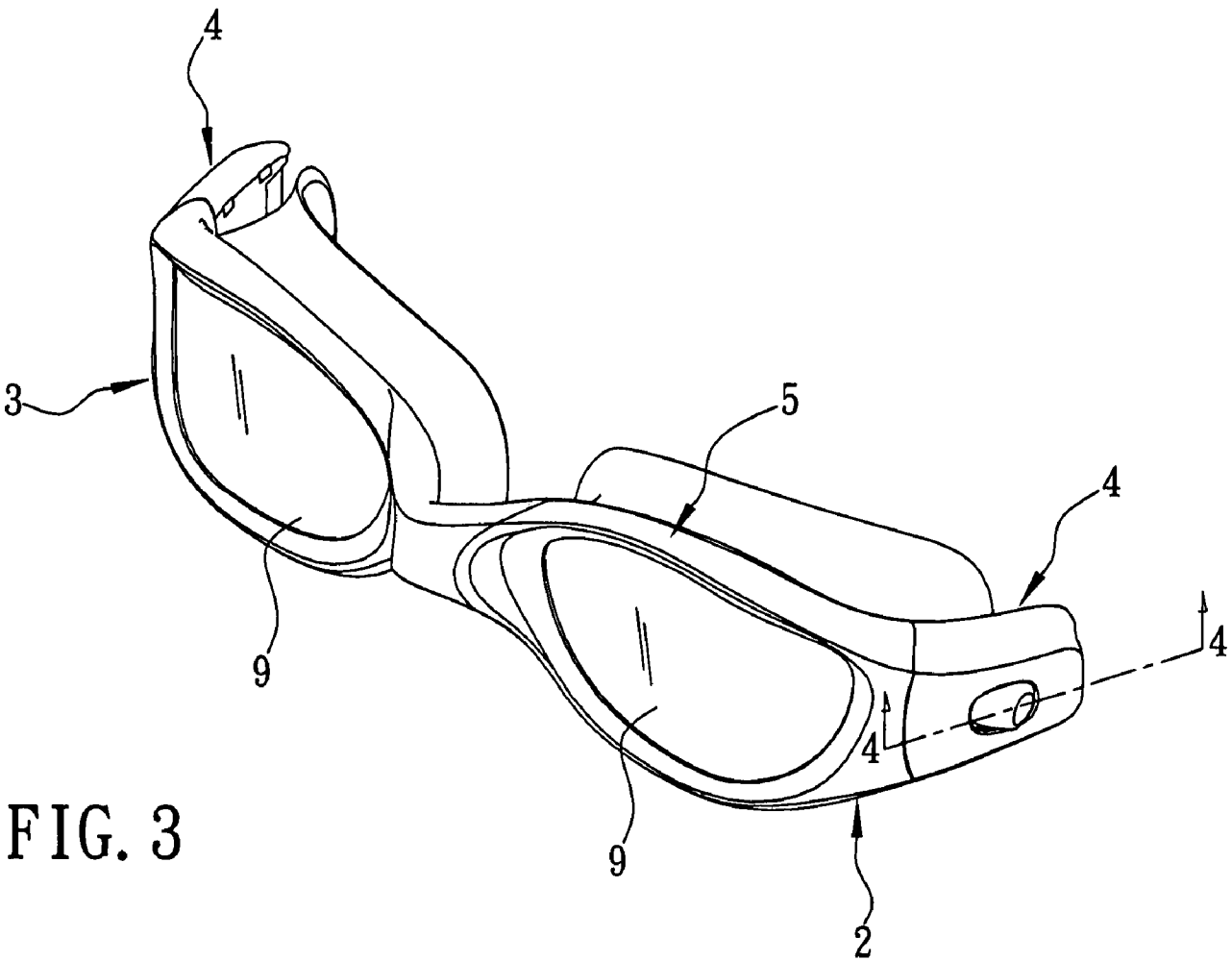
FIG. 3 is an assembled view of the swimming goggles of FIG. 1.

Referring to FIGS. 2 and 3 in conjunction with FIG. 1, in assembly, the lenses 9 are first disposed integrally in the receiving spaces 22, 32 of the respective left and right lens frames 2, 3 of rigid materials, and the nose bridge 50, the enclosing frames 51 and the gaskets 52 of the connecting device 5 of resilient materials enclose the left and right lens frames 2, 3 together with the lenses 9 as a unit from the inner side. The fixed pivot 41 of the stop lever is then assembled to the pivot holes 403 of the base 40, with the resilient arms 42 movably received in both the concaves 406 of the projection 405 of the base 40 and the grooves 26 of the engaging seat 23, as illustrated in FIG. 2. Finally, the panel 43 is assembled to the base 40 via the engagement between the engaging posts 432 and the engaging slots 400. Thus, a pair of swimming goggles 1 in accordance with the present invention is obtained as shown in FIG. 3.

As shown in FIG. 4, after assembly, the head strap 8 may be wound around the strap post 404 of the base 40 through the strap opening 408 from the inner side, with the stop tongue 410 of the stop lever abutting against one inner side of a stop groove 80 of the head strap 8. At this moment, when pulled, the head strap 8 can only be moved in one direction as indicated by the arrow, that is, the head strap 8 can only be tightened. Referring to FIG. 5, when it is desired to loosen the head strap 8, the push button 411 should be pressed inwardly. Consequently, the stop tongue 410 is lifted and becomes disengaged from the inner side of a corresponding stop channel 80 of the head strap 8, whereby the head strap 8 may also be pulled in an opposite direction besides the aforesaid one direction, thus allowing the head strap 8 to be loosened. When the push button 411 is pressed, the resilient arms 42 correspondingly move inwardly and resiliently deform. When the force exerted on the push button 411 is released, the push button 411 resumes to its original position by the restoring force provided by the resilient arms 42, and the stop tongue 410 abuts against an inner side of a new stop channel 80 of the head strap 8.

In use, before putting on the swimming goggles 1, the wearer may first increase the length of the head strap 8 to facilitate wear, and then pull opposite ends of the head strap 8 from opposite sides of the lens frames 2, 3 to tighten the head strap 8, so that the actual size of his/her head may be matched. This tightening operation is significantly facilitated since only one time operation is required. When loosening the head strap 8, as illustrated in FIG. 5, the push button 411 is first pressed, allowing the wearer to pull one end of the head strap 8 to a suitably increased length, and then release the push button 411 to fulfill the adjusting operation. Accordingly, by the provision of the strap adjusting device 4 of the present invention, the head strap 8 of the swimming goggles 1 may be easily tightened or loosened directly without taking off the swimming goggles 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pair of swimming goggles, comprising:

a connecting device;

a pair of lenses;

left and right lens frames assembled to the connecting device as a unit, each lens frame having an outer surface and an inner surface defining a receiving space therebetween retaining one lens therein, and an engaging seat provided on an outer side thereof, the engaging seat having a first engaging portion and a second engaging portion;

a head strap; and a pair of strap adjusting devices assembled to the engaging seats of the respective left and right lens frames, each strap adjusting device comprising:

a base having a pair of opposite side portions each defining a pivot hole, a strap post disposed between the side portions and adjacent to the pivot holes, a strap opening located between the strap post and the pivot holes for extension of one end of the head strap therethrough, a projection disposed between the side portions and opposite to the strap post, and a snapping portion receiving the first engaging portion of the engaging seat of a corresponding lens frame;

a stop lever comprising a fixed pivot with opposite ends received in the pivot holes of the base, a stop tongue disposed proximate to the strap post of the base for engaging with the head strap, and a push button opposite to the stop tongue;

a resilient element for providing the restoring force to the push button when the push button is pressed; and a panel assembled to the base, the panel having a hole for extension of the push button therethrough, and a latching portion engaging with the second engaging portion of the engaging seat of a corresponding lens frame;

wherein the head strap may be directly tightened by pulling, or may be loosened by pressing the push button to disengage the stop tongue of the stop lever from the head strap without taking off the swimming goggles.

2. The swimming goggles as described in claim 1, wherein the engaging seat has a thickness smaller than that of the lens frame, forming a step with the lens frame, and the panel flushes with outer side edges of the lens frame.

3. The swimming goggles as described in claim 2, wherein the resilient element consists of two resilient arms disposed on opposite sides of the push button, each resilient arm having one end connected with the fixed pivot and the other end resting on the projection, the other end being bent into a curved configuration.

4. The swimming goggles as described in claim 3, wherein the projection defines two concaves receiving the other ends of the resilient arms.

5. The swimming goggles as described in claim 4, wherein the projection projects outwardly beyond the side portions of the base, and the resilient arms rest on the projection in an inclined manner.

6. The swimming goggles as described in claim 5, wherein the first engaging portion is an engaging strip formed on the outer side of the engaging seat, and the snapping portion of the base is a slit receiving the engaging strip by a snap engagement therebetween.

7. The swimming goggles as described in claim 6, wherein the second engaging portion is a pair of positioning slots defined in the junction of an inner side of the engaging seat and the outer side of the lens frame, and the latching portion of the panel is a pair of posts engaging with the positioning slots.

8. The swimming goggles as described in claim 7, wherein the engaging seat defines a pair of grooves opposite to the second engaging portion.

9. The swimming goggles as described in claim 1, wherein the base defines a pair of engaging slots in opposite sides of a bottom portion thereof, and the panel comprises a pair of engaging posts for being received in the engaging slots, thereby assembling the panel and the base together.

10. The swimming goggles as described in claim 1, wherein the push button has an inclined surface for facilitating press operation of the wearer's finger.

11. The swimming goggles as described in claim 10, wherein the distance between the fixed pivot and the tip of the inclined surface of the push button is larger than that between the fixed pivot and a free end of the stop tongue, whereby the push button can be easily pressed to cause the stop tongue to move correspondingly.

12. A pair of swimming goggles, comprising:

a pair of lenses;

left and right lens frames made of rigid materials, each lens frame having an outer surface and an inner surface defining a receiving space therebetween retaining one lens therein, a bearing portion extending from an inner side thereof, and an engaging seat provided on an outer side thereof, the engaging seat having a first engaging portion and a second engaging portion;

a connecting device made of resilient materials and comprising an integral nose bridge, a pair of enclosing frames and a pair of gaskets, the nose bridge enclosing the bearing portions of the lens frames therein, the enclosing frames being integrally disposed on the inner surfaces of the left and right lens frames for connecting the left and right lens frames together as a unit;

a head strap; and a pair of strap adjusting devices assembled to the engaging seats of the respective left and right lens frames, each strap adjusting device comprising:

a base having a pair of opposite side portions each defining a pivot hole, a strap post disposed between the side portions and adjacent to the pivot holes, a strap opening located between the strap post and the pivot holes for extension of one end of the head strap therethrough, a projection disposed between the side portions and opposite to the strap post, a snapping portion receiving the first engaging portion of the engaging seat of a corresponding lens frame, and a pair of engaging slots defined in opposite sides of a bottom portion thereof;

a stop lever comprising a fixed pivot with opposite ends received in the pivot holes of the base, a stop tongue disposed proximate to the strap post of the base for engaging with the head strap, and a push button opposite to the stop tongue;

a pair of resilient arms disposed on opposite sides of the push button, each resilient arm having one end connected with the fixed pivot and the other end resting on the projection; and a panel assembled to the base, the panel having a hole for extension of the push button therethrough, a latching portion engaging with the second engaging portion of the engaging seat of a corresponding lens frame, and a pair of engaging posts received in the engaging slots of the base;

wherein the head strap may be directly tightened by pulling, or may be loosened by pressing the push button to disengage the stop tongue of the stop lever from the head strap without taking off the swimming goggles.

13. The swimming goggles as described in claim 12, wherein the engaging seat has a thickness smaller than that of the lens frame, forming a step with the lens frame, and the panel flushes with outer side edges of the lens frame.

14. The swimming goggles as described in claim 13, wherein the projection defines two concaves receiving one ends of the resilient arms.

15. The swimming goggles as described in claim 14, wherein said one end of the resilient arm is bent into a curved configuration.

16. The swimming goggles as described in claim 15, wherein the first engaging portion is an engaging strip formed on the outer side of the engaging seat, and the snapping portion of the base is a slit receiving the engaging strip by a snap engagement therebetween.

17. The swimming goggles as described in claim 16, wherein the second engaging portion is a pair of positioning slots defined in the junction of an inner side of the engaging seat and the outer side of the lens frame, and the latching portion of the panel is a pair of posts for engaging with the positioning slots.

18. The swimming goggles as described in claim 12, wherein each lens defines a plurality of filling holes in the rim thereof for reinforcing the assembly of the lens with the lens frame.

19. The swimming goggles as described in claim 12, wherein the push button has an inclined surface for facilitating press operation of the wearer's finger.

20. The swimming goggles as described in claim 19, wherein the distance between the fixed pivot and the tip of the inclined surface of the push button is larger than that between the fixed pivot and a free end of the stop tongue, whereby the push button can be easily pressed to cause the stop tongue to move correspondingly.

* * * * *